US007373294B2

(12) United States Patent
Cezanne et al.

(10) Patent No.: US 7,373,294 B2
(45) Date of Patent: May 13, 2008

(54) INTONATION TRANSFORMATION FOR SPEECH THERAPY AND THE LIKE

(75) Inventors: Juergen Cezanne, Tinton Falls, NJ (US); Sunil K. Gupta, Edison, NJ (US); Chetan Vinchhi, Marlboro, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 999 days.

(21) Appl. No.: 10/438,642

(22) Filed: May 15, 2003

(65) Prior Publication Data

US 2004/0230421 A1 Nov. 18, 2004

(51) Int. Cl.
*G10L 11/04* (2006.01)
*G10L 21/00* (2006.01)

(52) U.S. Cl. ..... 704/207; 704/211

(58) Field of Classification Search ..... None
See application file for complete search history.

(56) References Cited

U.S. PATENT DOCUMENTS

| | | | | | |
|---|---|---|---|---|---|
| 4,615,680 | A | * | 10/1986 | Tomatis | 434/157 |
| 4,631,746 | A | * | 12/1986 | Bergeron et al. | 704/217 |
| 4,783,802 | A | | 11/1988 | Takebayashi et al. | 381/41 |
| 5,581,656 | A | * | 12/1996 | Hardwick et al. | 704/258 |
| 5,611,018 | A | * | 3/1997 | Tanaka et al. | 704/215 |
| 5,815,639 | A | | 9/1998 | Bennett et al. | 395/2.44 |
| 5,926,787 | A | | 7/1999 | Bennett et al. | 704/235 |
| 5,946,654 | A | | 8/1999 | Newman et al. | 704/246 |
| 5,963,903 | A | | 10/1999 | Hon et al. | 704/254 |
| 5,983,177 | A | | 11/1999 | Wu et al. | 704/244 |
| 5,995,932 | A | * | 11/1999 | Houde | 704/261 |
| 6,108,627 | A | | 8/2000 | Sabourin | 704/243 |
| 6,151,575 | A | | 11/2000 | Newman et al. | 704/260 |
| 6,163,768 | A | | 12/2000 | Sherwood et al. | 704/235 |
| 6,243,680 | B1 | | 6/2001 | Gupta et al. | 704/260 |
| 6,272,464 | B1 | | 8/2001 | Kiraz et al. | 704/257 |
| 6,358,054 | B1 | * | 3/2002 | Rothenberg | 434/185 |
| 6,389,395 | B1 | | 5/2002 | Ringland | 704/254 |
| 6,434,521 | B1 | | 8/2002 | Barnard | 704/244 |
| 6,585,517 | B2 | | 7/2003 | Wasowicz | 434/167 |
| 6,714,911 | B2 | | 3/2004 | Waryas et al. | 704/271 |

(Continued)

OTHER PUBLICATIONS

Cox, R. Crochiere, R. Johnston, J. "Real time implementation of time domain harmonic scaling of speech for rate modification and coding" Acoustics, Speech and Signal Processing, vol. 1, Feb. 1983.*

(Continued)

*Primary Examiner*—David Hudspeth
*Assistant Examiner*—Matthew J Sked

(57) ABSTRACT

The intonation of speech is modified by an appropriate combination of resampling and time-domain harmonic scaling. Resampling increases (upsampling) or decreases (downsampling) the number of data points in a signal. Harmonic scaling adds or removes pitch cycles to or from a signal. The pitch of a speech signal can be increased by combining downsampling with harmonic scaling that adds an appropriate number of pitch cycles. Alternatively, pitch can be decreased by combining upsampling with harmonic scaling that removes an appropriate number of pitch cycles. The present invention can be implemented in an automated speech-therapy tool that is able to modify the intonation of prerecorded reference speech signals for playback to a user to emphasize the correct pronunciation by increasing the pitch of selected portions of words or phrases that the user had previously mispronounced.

20 Claims, 4 Drawing Sheets

U.S. PATENT DOCUMENTS

| | | | | |
|---|---|---|---|---|
| 6,912,498 | B2 | 6/2005 | Stevens et al. | 704/235 |
| 6,952,673 | B2 | 10/2005 | Amir et al. | 704/235 |
| 7,149,690 | B2 | 12/2006 | August et al. | 704/270 |
| 2002/0095282 | A1 | 7/2002 | Goronzy et al. | 704/10 |
| 2002/0111805 | A1 | 8/2002 | Goronzy et al. | 704/250 |
| 2002/0128820 | A1 | 9/2002 | Goronzy et al. | 704/10 |
| 2002/0184009 | A1* | 12/2002 | Heikkinen | 704/219 |
| 2003/0182106 | A1* | 9/2003 | Bitzer et al. | 704/207 |

OTHER PUBLICATIONS

Violaro, F. Boeffard, O. "A hybrid model for TTS synthesis" IEEE transactions on speech and audio processing, vol. 6, Sep. 1998.*

"Time-Domain Algorithms for Harmonic Bandwidth Reduction and Time Scaling of Speech Signals" by David Malah, IEEE Transactions on Acoustics, Speech, and Signal Processing, vol. ASSP-27, No. 2, Apr. 1979, pp. 121-133.

"A Modern Approach to Dysarthria Classification" by Eduardo Castillo Guerra et al., Proceedings of the 25th Annual International Conference of the IEEE EMBS, Cancun, Mexico, Sep. 17-21, 2003, 5 pages.

"Diagnosis of Vocal and Voice Disorders by the Speech Signal." by Carlos Hernandez-Espinosa et al., Neural Networks, 2000. IJCNN 2000, Proceedings of the IEEE-International Joint Conference on Jul. 24-27, 2000, vol. 4, 7 pages.

"Computer Assisted Treated for Motor Speech Disorders" by Selim S. Awad, Ph.D. et al., 1999 IEEE, pp. 595-600. Instrumentation and Measurement Technology Conference IMTC/99, Proceedings of the 16th IEEE.

"Automatic babble recognition for early detection of speech related disorders" by Harriet J. Fell et al., Behaviour & Information Technology, 1999, vol. 18, No. 1, pp. 56-63.

"Acoustical recognition of laryngeal pathology using the fundamental frequency and the first three formants of vowels" by E. Perrin et al., Medical & Biological Engineering & Computing, Jul. 1997, vol. 35, No. 4, 9 pages.

"Spectral Pattern Recognition Improved Voice Quality" by Heikki Rihkanen et al., Journal of Voice, vol. 8, No. 4, 1994, pp. 320-326.

"Dysphonia Detected by Pattern Recognition of Spectral Composition" by Lea Leinonen et al., Journal of Speech and Hearing Research, vol. 35, Apr. 1992, pp. 287-295.

"Wavelet-FILVQ Classifier for Speech Analysis" by G. Van de Wouwer et al., 5 pages. Proceedings in the 13th annual conference on pattern recognition 1996.

"Automatic Detection and Segmentation of Pronunciation Variants in German Speech Corpora" by Andreas Kipp et al., pp. 106-109. ICSLP96.

"Automatic Recognition of Dutch Dysarthic Speech a Pilot Study" by Eric Sanders et al., 4 pages. In Proc. Internat. Conf. Spoken Language Processing 2002.

"The Use of Accent-Specific Pronunciation Dictionaries in Acoustic Model Training" by J.J. Humphries and P.C. Woodland, Acoustics, Speech and Signal Processing, 1998, Proceedings International Conference, May 12-15, 1998, vol. 1, pp. 317-320.

* cited by examiner

INTONATION TRANSFORMATION FOR SPEECH THERAPY AND THE LIKE

BACKGROUND OF THE INVENTION

1. Field of the Invention

The present invention relates generally to audio signal processing and more specifically to automated tools for applications such as speech therapy and language instruction.

2. Description of the Related Art

Intonation is an important aspect of speech, especially in the context of spoken language. Intonation is associated with a speech utterance and it represents features of speech such as form (e.g., statement, question, exclamation), emphasis (a word in a phrase or part of word can be emphasized), tone, etc.

The benefits of intonation variation as an aid to speech therapy are known. In a typical case, a speech therapist listens to the live or recorded attempts of a student to pronounce test words or phrases. In the event the student has difficulty pronouncing one or more words, the therapist identifies and stresses the mispronounced words for the student by repeating the word to the student with an exaggerated intonation in which the pitch contour of the word or one or more parts of the word is modified. Generally, the student will make another attempt to properly pronounce the word. The process typically would be repeated as necessary until the therapist is satisfied with the student's pronunciation of the target word. Continued failure to properly pronounce the word could invoke progressively more severe intonation variations for added emphasis.

Automated tools for general speech therapy are known in the art. The automated tools currently available for speech therapy are typically software programs running on general-purpose computers. Coupled to the computer is a device, such as a video monitor or speaker, for presenting one or more test words or phrases to a student. Test words or phrases are displayed to the student on the monitor or played through the speaker. The student speaks the test words or phrases. An input device, such as a microphone, captures the spoken words or phrases of the student and records them for later analysis by an instructor and/or scores them on such components as phoneme pronunciation, intonation, duration, overall speaking rate, and voicing. These tools, however, do not provide a mechanism for automated intonation variation as an aid to speech therapy.

SUMMARY OF THE INVENTION

The problems in the prior art are addressed in accordance with the principles of the present invention by a system that can automatically perform an arbitrary transformation of intonation for applications such as speech therapy or language instruction. In particular, the system can change the pitch of a word or one or more parts of a word rendered to a user by an audio speaker of the system. According to one embodiment of the invention, pitch can be changed by combining the signal-processing techniques of resampling and time-domain harmonic scaling. Resampling involves increasing or decreasing the sampling rate of a digital signal. Time-domain harmonic scaling involves compressing or expanding a speech signal (e.g., by removing an integer number of pitch periods from one or more segments of the speech signal or by replicating an integer number of pitch periods in one or more speech segments, where each speech segment may correspond to a frame in the speech signal).

For example, increasing the pitch of an audio signal corresponding to a word or part of a word can be achieved by downsampling the original audio signal followed by harmonic scaling that expands the downsampled signal to achieve an output signal having approximately the same number of samples as the original audio signal. When the resulting output signal is rendered at the nominal playback rate, the pitch will be higher than that of the original audio signal, resulting in a transformed intonation for that word. Similarly, the pitch of an audio signal can be decreased by combining upsampling with harmonic scaling that compresses the upsampled signal. Depending on the embodiment, resampling can be implemented either before or after harmonic scaling.

Transformation of intonation using the present invention can lead to significant enhancements to automatic or computer-based applications related to speech therapy, language learning, and the like. For example, an automated speech therapy tool running on a personal computer can be designed to play a sequence of prerecorded words and phrases to a user. After each word or phrase is played to the user, the user repeats the word or phrase. The computer analyzes the user's response to characterize the quality of the user's speech. When the computer detects an error or errors in the user's utterance of the word or phrase, the computer can appropriately transform the intonation of the pre-recorded word or phrase by selectively modifying the pitch contour of those parts of the word or phrase that correspond to errors in the user's utterance in order to emphasize the correct pronunciation to the user. Possible errors in user's utterances include, for example, errors in intonation and phonological disorders as well as mispronunciations. In this specification, references to pronunciation and mistakes or errors in pronunciation should be interpreted to include possible references to these other aspects of speech utterances.

Depending on the implementation, the process of playing the word or phrase with transformed intonation to the user and analyzing the user's response can be repeated until the user's response is deemed correct or otherwise acceptable before continuing on to the next word or phrase in the sequence. In this way, the present invention can be used to provide an automated, interactive speech therapy tool that is capable of correcting a user's utterance mistakes in real time.

According to one embodiment, the present invention is a method for generating an output audio signal from an input audio signal having a number of pitch cycles, where each input pitch cycle is represented by a plurality of data points. The method comprises a combination of resampling and harmonic scaling. The resampling comprises changing the number of data points in an audio signal, while the harmonic scaling comprises changing the number of pitch cycles in an audio signal. The output audio signal has a pitch that is different from the pitch of the input audio signal.

According to another embodiment, the present invention is a computer-implemented method that compares a user speech signal to a reference speech signal to select one or more parts of the reference speech signal to emphasize. The one or more selected parts of the reference speech signal are processed to generate an intonation-transformed speech signal, and the intonation-transformed speech signal is played to the user.

BRIEF DESCRIPTION OF THE DRAWINGS

Other aspects, features, and benefits of the present invention will become more fully apparent from the following detailed description, the appended claims, and the accompanying drawings in which:

DETAILED DESCRIPTION

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments.

The present invention will be described primarily within the context of methods and apparatuses for automated, interactive speech therapy. It will be understood by those skilled in the art, however, that the present invention is also applicable within the context of language learning, electronic spoken dictionaries, computer-generated announcements, voice prompts, voice menus, and the like.

Figure 1:
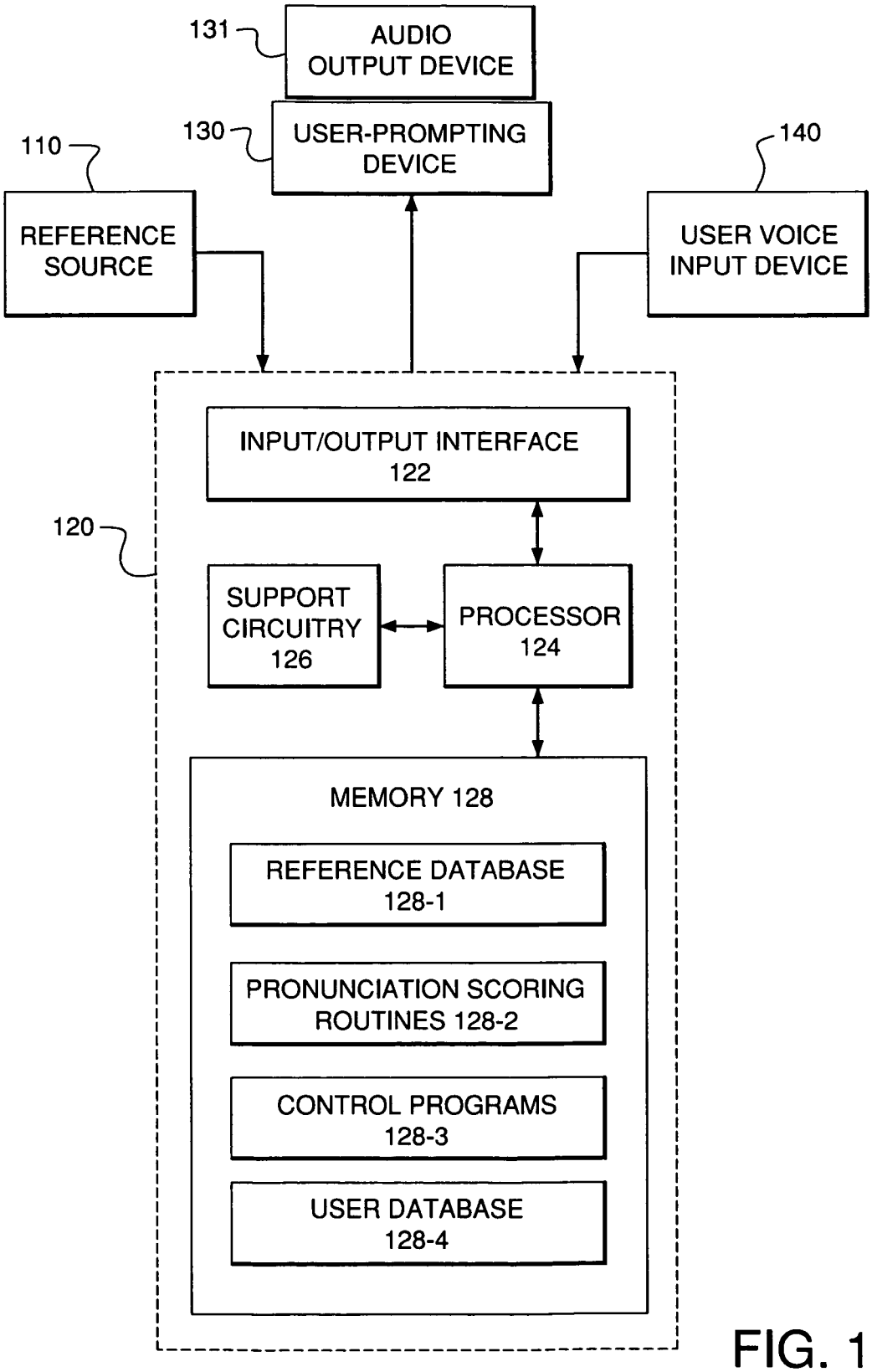
FIG. 1 depicts a high-level block diagram of an audio signal-processing system, according to one embodiment of the invention.

FIG. 1 depicts a high-level block diagram of a system 100 according to one embodiment of the invention. Specifically, system 100 comprises a reference speaker source 110, a controller 120, a user-prompting device 130, and a user voice input device 140. System 100 may comprise hardware typically associated with a standard personal computer (PC) or other computing device. Depending on the implementation, the intonation engine described below may reside locally in a user's PC or remotely at a server location accessible via, for example, the Internet or other computer network.

Reference speaker source 110 comprises a live or recorded source of reference audio information. The reference audio information is subsequently stored within a reference database 128-1 in memory 128 within (or accessible by) controller 120. User-prompting device 130 comprises a device suitable for prompting a user to respond and, generally, perform tasks in accordance with the present invention and related apparatus and methods. User-prompting device 130 may comprise a display device having associated with it an audio output device 131 (e.g., speakers). The user-prompting device is suitable for providing audio and, optionally, video or graphical feedback to a user. User voice input device 140 comprises, illustratively, a microphone or other audio input device that responsively couples audio or voice input to controller 120.

Controller 120 comprises a processor 124, input/output (I/O) circuitry 122, support circuitry 126, and memory 128. Processor 124 cooperates with conventional support circuitry 126 such as power supplies, clock circuits, cache memory, and the like as well as circuits that assist in executing software routines stored in memory 128. As such, it is contemplated that some of the process steps discussed herein as software processes may be implemented within hardware, for example, using support circuitry that cooperates with processor 124 to perform such process steps. I/O circuitry 122 forms an interface between the various functional elements communicating with controller 120. For example, in the embodiment of FIG. 1, controller 120 communicates with reference speaker source 110, user-prompting device 130, and user voice input device 140 via I/O circuitry 122.

Although controller 120 is depicted as a general-purpose computer that is programmed to perform various control functions in accordance with the present invention, the invention can be implemented in hardware as, for example, an application-specific integrated circuit (ASIC). As such, the process steps described herein should be broadly interpreted as being equivalently performed by software, hardware, or a combination thereof.

Memory 128 is used to store a reference database 128-1, pronunciation scoring routines 128-2, control and other programs 128-3, and a user database 128-4. Reference database 128-1 stores audio information received from, for example, reference speaker source 110. The audio information stored within reference database 128-1 may also be supplied via alternative means such as a computer network (not shown) or storage device (not shown) cooperating with controller 120. The audio information stored within reference database 128-1 may be provided to user-prompting device 130, which responsively presents the stored audio information to a user.

Pronunciation scoring routines 128-2 comprise one or more scoring algorithms suitable for use in the present invention. Briefly, scoring routines 128-2 include one or more of an articulation-scoring routine, a duration-scoring routine, and/or an intonation-and-voicing-scoring routine. Each of these scoring routines is implemented by processor 124 to provide a pronunciation scoring engine that processes voice or audio information provided by a user via, for example, user voice input device 140. Each of these scoring routines is used to correlate the audio information provided by the user to the audio information provided by a reference source to determine thereby a score indicative of such correlation. Suitable pronunciation scoring routines are described in U.S. patent application Ser. No. 10/188,539, filed on Jul. 3, 2002 as attorney docket no. Gupta 8-1-4, the teachings of which are incorporated herein by reference.

Programs 128-3 stored within memory 128 comprise various programs used to implement the functions described herein pertaining to the present invention. Such programs include those programs useful in receiving data from reference speaker source 110 (and optionally encoding that data prior to storage), those programs useful in processing and providing stored audio data to user-prompting device 130, those programs useful in receiving and encoding voice information received via user voice input device 140, and those programs useful in applying input data to the scoring engines, operating the scoring engines, and deriving results from the scoring engines. In particular, programs 128-3 include a program that can transform the intonation of a recorded word or phrase for playback to the user.

User database 128-4 is useful in storing scores associated with a user, as well as voice samples provided by the user such that a historical record may be generated to show user progress in achieving a desired language skill level.

Figure 2:
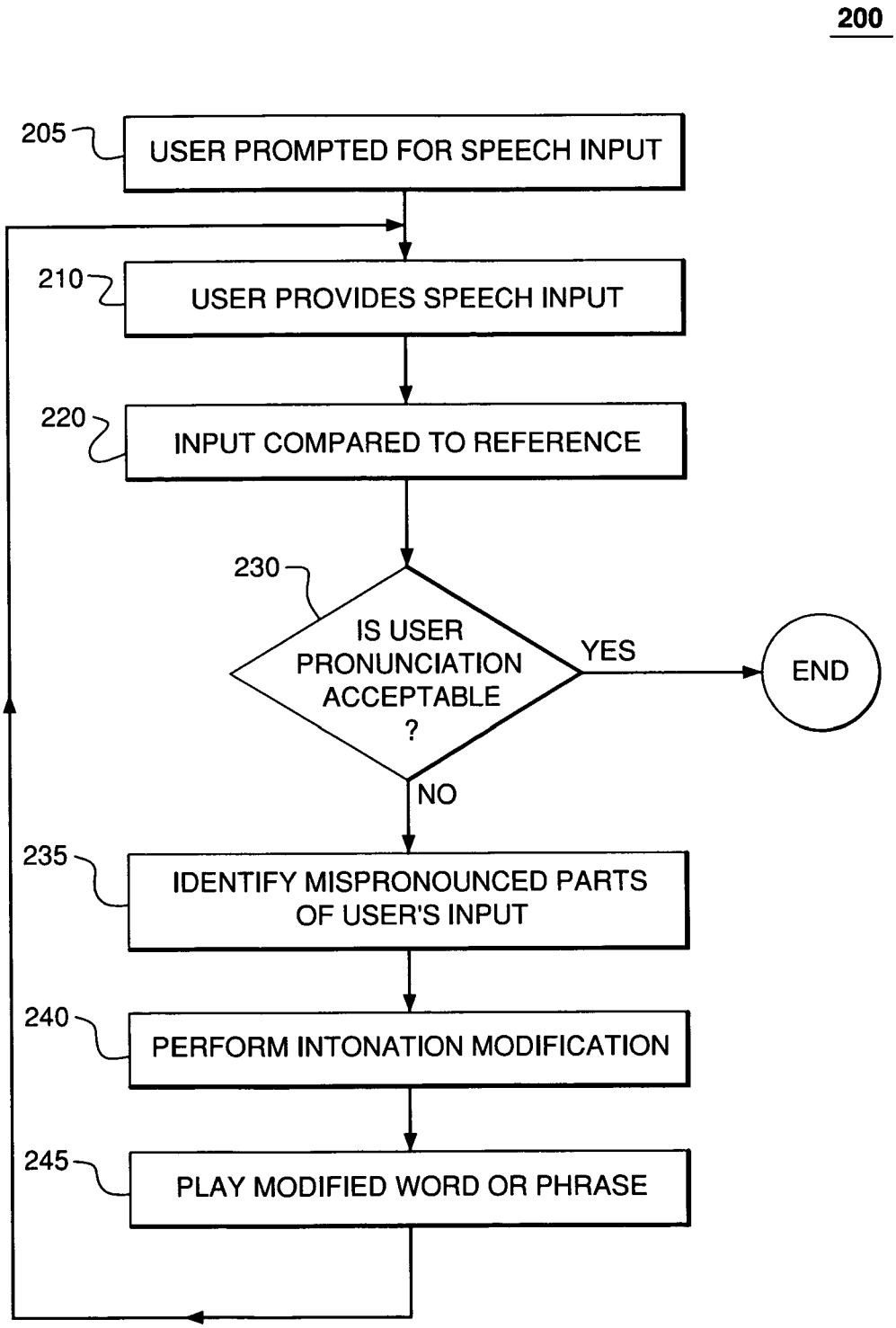
FIG. 2 depicts a flow chart of the process steps associated with an automated speech therapy tool, according to one embodiment of the invention.

FIG. 2 depicts a flow chart of the process steps associated with an automated speech therapy tool, according to one embodiment of the invention. In the context of FIG. 1, system 100 operates as such a tool when processor 124 implements appropriate routines and programs stored in memory 128.

Specifically, method 200 of FIG. 2 is entered at step 205 when a phrase or word pronounced by a reference speaker is presented to a user. That is, at step 205, a phrase or word stored within reference database 128-1 is presented to a user via user-prompting device 130 and/or audio output device 131, or some other suitable presentation device. In response to the presented phrase or word, at step 210, the user speaks the word or phrase into user voice input device 140. At step 220, processor 124 implements one or more pronunciation scoring routines 128-2 to process and compare the phrase or word input to voice input device 140 to the reference target stored in reference database 128-1. If, at step 230, processor 124 determines that the user's pronunciation of the phrase or word is acceptable, then the method terminates. Processing of method 200 can be started again by prompting at step 205 for additional speech input, for example, for a different phrase or word.

If the user's pronunciation of the phrase or word is not acceptable, then, at step 235, those parts of the word or phrase that were mispronounced are identified. Once the mispronounced parts are identified, intonation transformation is performed on the reference target at step 240. The intonation transformation might involve either an exaggeration or a de-emphasis of each of one or more parts/segments of the reference word or phrase. The resulting word or phrase with modified intonation is then audibly reproduced at step 245 for the user, e.g., by audio output device 131. Depending on the implementation, processing may then return to step 210 to record the user's subsequent pronunciation of the same word or phrase in response to hearing the reference word or phrase with transformed intonation.

Figure 3:
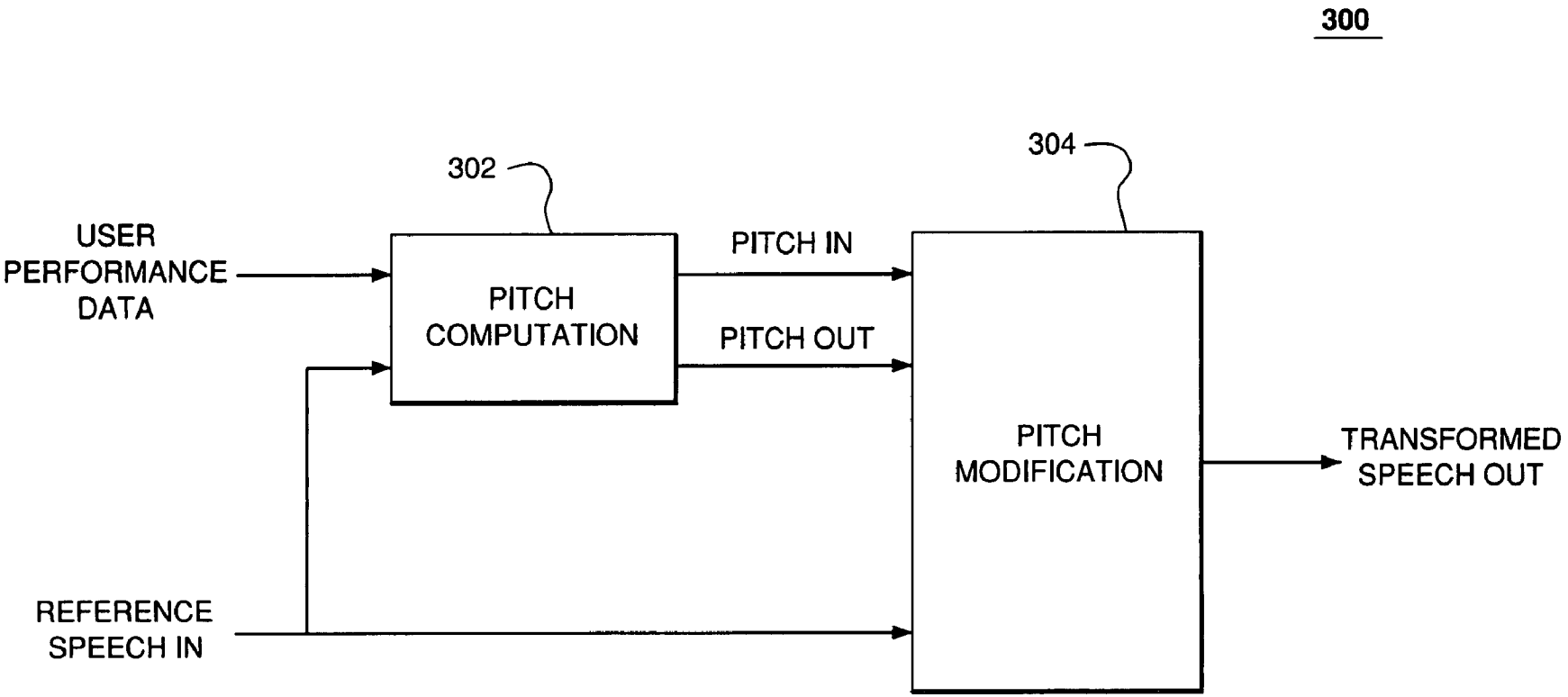
FIG. 3 shows a block diagram of a signal-processing engine that can be used to implement the intonation transformation step of FIG. 2.

FIG. 3 shows a block diagram of a signal-processing engine 300 that can be used to implement the intonation transformation of step 240 of FIG. 2. Signal-processing engine 300 receives an input speech signal corresponding to a reference word or phrase and generates an output speech signal corresponding to the reference word or phrase with transformed intonation. In particular, the transformed speech signal is generated by modifying the pitch of certain parts of the input reference speech signal. Signal-processing engine 300 receives user performance data (e.g., generated during step 220 of FIG. 2) that identifies which parts of the reference word or phrase are to be modified.

The input reference speech signal is processed in frames, where a typical frame size is 10 msec. Signal-processing engine 300 generates a 10-msec frame of output speech for every 10-msec frame of input speech. This condition does not apply to implementations (described later) that change the timing of speech signals in addition to changing the pitch.

Intonation can be represented as a pitch contour, i.e., the progression of pitch over a speech segment. Signal-processing engine 300 selectively modifies the pitch contour to increase or decrease the pitch of different parts of the speech signal to achieve desired intonation transformation. For example, if the pitch contour is rising for a part of a speech signal, then that part can be exaggerated by modifying the signal to make the pitch contour rise even faster.

Pitch computation block 302 implements a pitch extraction algorithm to extract the pitch (p_in) of the current frame in the input reference speech signal. The user performance data is then used to determine a desired pitch (p_out) for the corresponding frame in the transformed speech signal. Depending on whether and how this part of the reference speech is to be modified, for any given frame, p_out may be greater than, less than, or the same as p_in, where an increase in the pitch is achieved by setting p_out greater than p_in.

Pitch modification block 304 changes the pitch of the current frame of the input speech signal based on p_in and p_out to generate a corresponding frame for the output speech signal, such that the pitch of the output frame equals or approximates p_out. Depending on the relative values of p_in and p_out, the pitch may be increased, decreased, or left unchanged. Depending on the implementation, if p_in and p_out are the same for a particular frame, then pitch modification block 304 may be bypassed.

Figure 4:
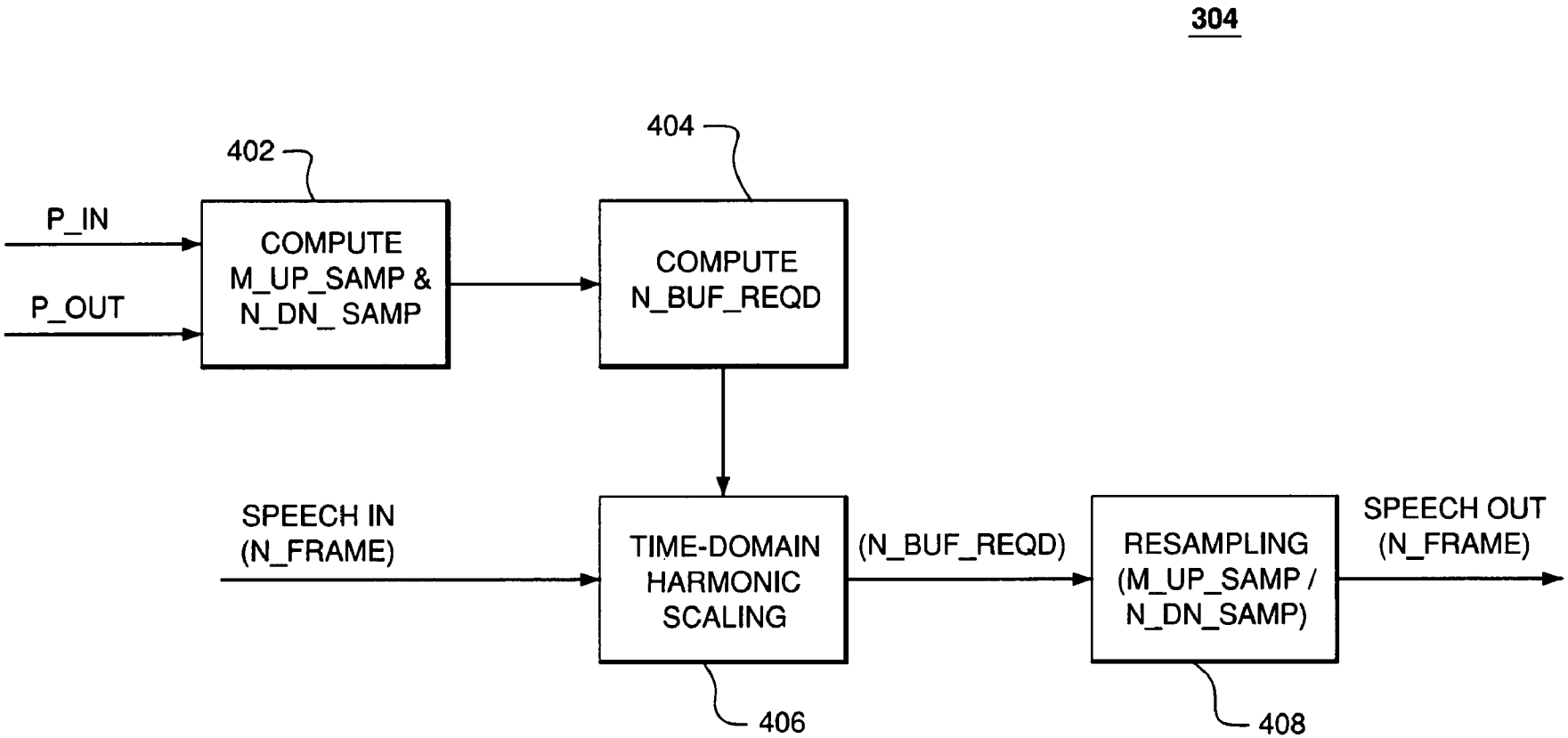
FIG. 4 shows a block diagram of the processing implemented for the pitch modification block of FIG. 3.

FIG. 4 shows a block diagram of the processing implemented for pitch modification block 304 of FIG. 3. According to this implementation of the present invention, pitch modification is achieved by a combination of time-domain harmonic scaling followed by resampling.

Time-domain harmonic scaling is a technique for changing the duration of a speech signal without changing its pitch. See, e.g., David Malah, *Time-Domain Algorithms for Harmonic Bandwidth Reduction and Time Scaling of Speech Signals*, IEEE Transactions on Acoustics, Speech, and Signal Processing, vol. ASSP-27, No. 2, April 1979, the teachings of which are incorporated herein by reference. Harmonic scaling is achieved by adding or deleting one or more pitch cycles to or from a waveform. In particular, the duration of a speech signal is increased by adding pitch cycles, while deleting pitch cycles decreases the duration.

Resampling involves generating more or fewer discrete samples of an input signal, i.e., increasing or decreasing the sampling rate with respect to time. See, e.g., A. V. Oppenheim, R. W. Schaefer, *Discrete-Time Signal Processing*, Prentice Hall, 1989, the teachings of which are incorporated herein by reference. Increasing the sampling rate is known as upsampling; decreasing the sampling rate is downsampling. Upsampling typically involves interpolating between existing data points, while downsampling typically involves deleting existing data points. Depending on the implementation, resampling may also involve output filtering to smooth the resampled signal.

According to certain embodiments of the present invention, harmonic scaling can be combined with resampling to generate an output frame of speech data that is the same size as its corresponding input frame but with a different pitch. Harmonic scaling changes the size of a frame of data without changing its pitch, while resampling can be used to change both the size and the pitch of a frame of data. By selecting appropriate levels of harmonic scaling and resampling, an input frame can be converted into an output frame of the same size, but with a different pitch that equals or approximates the desired pitch.

For example, to increase the pitch of a particular speech frame, the speech signal may first be downsampled. Downsampling results in fewer samples than are in the input frame. To compensate, the downsampled signal is harmonically scaled to add pitch cycles. Conversely, to decrease pitch, the input signal is upsampled and harmonic scaling is used to drop pitch cycles. Depending on the implementation, the resampling can be implemented either before or after the harmonic scaling.

Referring to FIG. 4, block 402 receives a measure p_in of the pitch of the current input frame and a measure p_out of the desired pitch for the corresponding output frame. In order to achieve the desired pitch transformation, the sampling of the input speech signal is modified by an amount that is proportional to (p_out/p_in). In general, p_out may be greater than or less than or equal to p_in. As such, the resampling may be based on a ratio (p_out/p_in) that is greater than, less than, or equal to 1. Such resampling by an arbitrary amount may be implemented with a (fixed) upsampling phase followed by a (variable) downsampling phase. The upsampling phase typically involves upsampling the input signal based on a (possibly fixed) large upsampling rate M_up_samp (such as 64 or 128 or some other appropriate integer), while the downsampling phase involves downsampling of the upsampled signal by an appropriately selected downsampling rate N_dn_samp, which may be any suitable integer value.

When p_out is greater than p_in (i.e., where the desired pitch of the output signal is greater than the pitch of the input signal), resampling involves an overall downsampling of the input speech signal. In this case, the downsampling rate N_dn_samp will be selected to be greater than the upsampling rate M_up_samp. Similarly, to decrease the pitch of the input signal (where p_out<p_in), resampling will involve an overall upsampling of the input signal, where the downsampling rate N_dn_samp is selected to be smaller than the large upsampling rate M up_samp. Block 402 calculates appropriate values for upsampling and downsampling rates M_up_samp and N_dn_samp corresponding to the input and desired output pitch levels p_in and p_out.

In the implementation shown in FIG. 4, harmonic scaling (block 406) is implemented before resampling (block 408). Both harmonic scaling and resampling change the number of data points in the signals they process. In order to ensure that the size of the output frame is the same (i.e., N_frame) as the size of the corresponding input frame, the number of data points add (or subtracted) during harmonic scaling needs to be the same as the number of data points subtracted (or added) during resampling. Block 404 computes the size (N_buf_reqd) of the buffer needed for the signal generated by the harmonic scaling of block 406. Nominally, N_buf_reqd equals N_frame*N_dn_samp/M_up_samp.

Block 406 applies time-domain harmonic scaling to scale the incoming reference speech frame (of N_frame samples) to generate N_buf_read samples of harmonically scaled data. When the pitch is to be increased, the harmonic scaling adds pitch cycles (e.g., by replicating one or more existing pitch cycles possibly followed by a smoothing filter to ensure signal continuity). When pitch is to be decreased, the harmonic scaling deletes one or more pitch cycles, again possibly followed by a smoothing filter.

Block 408 resamples the N_buf_reqd samples of harmonically scaled data from block 406 based on the resampling ratio (M_up_samp/N_dn_samp) to produce N_frame samples of transformed speech at the desired pitch of p_out. As described earlier, this resampling is preferably implemented by upsampling the harmonically scaled data from block 406 by M_up_samp, followed by downsampling the resulting upsampled data by N_dn_samp. In practice, the two processes can be fused together into a single filter bank.

Although intonation transformation processing has been described in the context of FIG. 3, where time-domain harmonic scaling is implemented prior to resampling, in alternative embodiments, resampling can be implemented prior to harmonic scaling.

Emphasis in speech may involve changes in volume (energy) and timing as well as changes in pitch. For example, when emphasizing a particular part of a word, in addition to increasing pitch, a speech therapist might also increase the volume and/or extend the duration of that part when pronouncing the word. Those skilled in the art will understand that the intonation transformation processing of the present invention may be extended to include changes to volume and/or timing of parts of speech signals in addition to changes in pitch.

Note that changing the timing of speech may be achieved by modifying the level of compression or expansion imparted by the harmonic scaling portion of the present invention. For example, as described earlier, increasing pitch can be achieved by a combination of downsampling and harmonic scaling that adds pitch cycles. Extending the duration of this higher-pitch portion of speech can be achieved by increasing the number of pitch cycles that are added during harmonic scaling. Note that, in implementations that combine timing transformation with pitch transformation, the size of (e.g., the number of data points in) the output signal will differ from the size of the input signal.

The frame-based processing of certain embodiments of this invention is suitable for inclusion in a system that works on real-time or streaming speech signals. In such applications, signal continuity is maintained so that the resultant signal will sound natural.

Although the invention has been described above in reference to an automated speech therapy tool, the algorithm for transforming intonation has general applicability. For example, although the present invention has been described in the context of processing used to change the pitch of speech signals, the present invention can be generally applied to change pitch in any suitable audio signals, including those associated with music instruction applications.

While this invention has been described with reference to illustrative embodiments, this description is not intended to be construed in a limiting sense. Various modifications of the described embodiments, as well as other embodiments of the invention, which are apparent to persons skilled in the art to which the invention pertains are deemed to lie within the principle and scope of the invention as expressed in the following claims.

Although the steps in the following method claims, if any, are recited in a particular sequence with corresponding labeling, unless the claim recitations otherwise imply a particular sequence for implementing some or all of those steps, those steps are not necessarily intended to be limited to being implemented in that particular sequence.

The present invention may be implemented as circuit-based processes, including possible implementation on a single integrated circuit. As would be apparent to one skilled in the art, various functions of circuit elements may also be implemented as processing steps in a software program. Such software may be employed in, for example, a digital signal processor, micro-controller, or general-purpose computer.

The present invention can be embodied in the form of methods and apparatuses for practicing those methods, including in embedded (real-time) systems. The present invention can also be embodied in the form of program code embodied in tangible media, such as floppy diskettes, CD-ROMs, hard drives, or any other machine-readable storage medium, wherein, when the program code is loaded into and executed by a machine, such as a computer, the machine becomes an apparatus for practicing the invention. The present invention can also be embodied in the form of program code, for example, whether stored in a storage medium, loaded into and/or executed by a machine, or transmitted over some transmission medium or carrier, such as over electrical wiring or cabling, through fiber optics, or via electromagnetic radiation, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits.

What is claimed is:

1. A method for generating an output audio signal from an input audio signal having a number of pitch cycles, each input pitch cycle represented by a plurality of data points, the method comprising a combination of resampling and harmonic scaling, wherein:

the resampling comprises changing the number of data points in an audio signal, wherein the resampling comprises an upsampling phase followed by a downsampling phase to achieve a desired resampling ratio, wherein:

the upsampling phase comprises upsampling the audio signal based on an upsampling rate value to generate an upsampled signal; and the downsampling phase comprises downsampling the upsampled signal based on a downsampling rate value selected to achieve, in combination with the upsampling phase, the desired resampling ratio; and the harmonic scaling comprises changing the number of pitch cycles in an audio signal, wherein the output audio signal has a pitch that is different from the pitch of the input audio signal.

2. The invention of claim 1, wherein the harmonic scaling is implemented before the resampling.

3. The invention of claim 1, wherein the number of data points in the output audio signal is the same as the number of data points in the input audio signal.

4. The invention of claim 1, further comprising changing the timing of the input audio signal, wherein the number of data points in the output audio signal is different from the number of data points in the input audio signal.

5. The invention of claim 1, further comprising changing the volume of the input audio signal.

6. The invention of claim 1, wherein the method is implemented to modify the intonation of speech corresponding to the input audio signal.

7. The invention of claim 6, wherein the method is implemented as part of a computer-implemented tool that modifies the intonation of one or more reference words or phrases played to a user of the tool.

8. The invention of claim 7, wherein the computer-implemented tool is a speech therapy tool.

9. The invention of claim 1, further comprising:

comparing a user speech signal to a reference speech signal to select one or more parts of the reference speech signal to emphasize;

applying the combination of resampling and harmonic scaling to change the pitch of the one or more selected parts of the reference speech signal to generate an intonation-transformed speech signal; and playing the intonation-transformed speech signal to the user.

10. The invention of claim 1, wherein the desired resampling ratio has a value other than one.

11. A machine-readable medium, having encoded thereon program code, wherein, when the program code is executed by a machine, the machine implements a method for generating an output audio signal from an input audio signal having a number of pitch cycles, each input pitch cycle represented by a plurality of data points, the method comprising a combination of resampling and harmonic scaling, wherein:

the resampling comprises changing the number of data points in an audio signal, wherein the resampling comprises an upsampling phase followed by a downsampling phase to achieve a desired resampling ratio, wherein:

the upsampling phase comprises upsampling the audio signal based on an upsampling rate value to generate an upsampled signal; and the downsampling phase comprises downsampling the upsampled signal based on a downsampling rate value selected to achieve, in combination with the upsampling phase, the desired resampling ratio; and the harmonic scaling comprises changing the number of pitch cycles in an audio signal, wherein the output audio signal has a pitch that is different from the pitch of the input audio signal.

12. A computer-implemented method comprising:

comparing a user speech signal to a reference speech signal to select one or more parts of the reference speech signal to emphasize;

processing the one or more selected parts of the reference speech signal to generate an intonation-transformed speech signal, wherein generating the intonation-transformed speech signal comprises applying a combination of resampling and harmonic scaling to change the pitch of the one or more selected parts of the reference speech signal, wherein:

the resampling comprises changing the number of data points in an audio signal; and the harmonic scaling comprises changing the number of pitch cycles in an audio signal; and playing the intonation-transformed speech signal to the user.

13. The invention of claim 12, wherein the harmonic scaling is implemented before the resampling.

14. The invention of claim 12, wherein the number of data points in the output audio signal is the same as the number of data points in the input audio signal.

15. The invention of claim 12, further comprising changing the timing of the input audio signal, wherein the number of data points in the output audio signal is different from the number of data points in the input audio signal.

16. The invention of claim 12, further comprising changing the volume of the input audio signal.

17. The invention of claim 12, wherein the resampling comprises an upsampling phase followed by a downsampling phase to achieve a desired resampling ratio, wherein:

the upsampling phase comprises upsampling the audio signal based on an upsampling rate value to generate an upsampled signal; and the downsampling phase comprises downsampling the upsampled signal based on a downsampling rate value selected to achieve, in combination with the upsampling phase, the desired resampling ratio.

18. The invention of claim 17, wherein the desired resampling ratio has a value other than one.

19. The invention of claim 12, wherein the method is implemented as part of a computer-implemented tool that modifies the intonation of one or more reference words or phrases played to a user of the tool.

20. A machine-readable medium, having encoded thereon program code, wherein, when the program code is executed by a machine, the machine implements a method comprising:

comparing a user speech signal to a reference speech signal to select one or more parts of the reference speech signal to emphasize;

processing the one or more selected parts of the reference speech signal to generate an intonation-transformed speech signal, wherein generating the intonation-transformed speech signal comprises applying a combination of resampling and harmonic scaling to change the pitch of the one or more selected parts of the reference speech signal, wherein:

the resampling comprises changing the number of data points in an audio signal; and the harmonic scaling comprises changing the number of pitch cycles in an audio signal; and playing the intonation-transformed speech signal to the user.

* * * * *